US006554927B1

(12) United States Patent
Hardwick

(10) Patent No.: US 6,554,927 B1
(45) Date of Patent: Apr. 29, 2003

(54) METHOD OF EXPLOSIVE BONDING, COMPOSITION THEREFOR AND PRODUCT THEREOF

(75) Inventor: Roy Hardwick, Troon (GB)

(73) Assignee: Sigmabond Technologies Corporation, Kirkfield (CA)

( * ) Notice: Subject to any disclaimer, the term of this patent is extended or adjusted under 35 U.S.C. 154(b) by 216 days.

(21) Appl. No.: 09/718,421

(22) Filed: Nov. 24, 2000

(51) Int. Cl.[7] ..... C06B 45/10

(52) U.S. Cl. ..... 149/18; 149/46; 149/110; 149/55

(58) Field of Search ..... 149/18, 46, 110, 149/55

(56) References Cited

U.S. PATENT DOCUMENTS 3,797,392 A * 3/1974 Eckels ..... 149/2
3,805,120 A * 4/1974 Cranston ..... 174/52.4
3,925,122 A * 12/1975 Berthmann et al. ..... 149/18
4,038,112 A * 7/1977 Asaoka ..... 149/110
RE29,334 E * 8/1977 Ryan et al. ..... 149/18
4,363,678 A * 12/1982 Nishimura et al. ..... 149/110
4,706,567 A * 11/1987 Schmid et al. ..... 102/284
5,139,588 A * 8/1992 Poole ..... 149/61
5,226,579 A * 7/1993 Bergmann et al. ..... 219/78.02
5,611,477 A * 3/1997 Wang ..... 228/107
5,702,614 A * 12/1997 Taylor ..... 210/170

* cited by examiner

*Primary Examiner*—Edward A. Miller
(74) *Attorney, Agent, or Firm*—Morgan, Lewis & Bockius LLP

(57) ABSTRACT

An improved method of explosively bonding a first metal to a second metal with an explosive composition comprising a base explosive in admixture with an inert particulate material, the improvement wherein the diluent comprises an inert material having a mean particle size selected from 0.05 mm to 0.1 mm, a hardness value of not less than 4 mohs, and a plurality of faces and edges. The explosive composition allows for a sustainable detonation value of less than 1800 m/s, preferably less than 1200 m/s to reduce or prevent the formation of interface waves.

3 Claims, 2 Drawing Sheets

METHOD OF EXPLOSIVE BONDING, COMPOSITION THEREFOR AND PRODUCT THEREOF

FIELD OF THE INVENTION

This invention relates to a method of explosively bonding at least two metals together without forming interface waves during the bonding process, particularly to an explosive composition of use in the method and, more particularly, to the multi-metallic product thereof.

BACKGROUND TO THE INVENTION

The present invention relates to a method of producing explosively bonded interfaces of a pair of metals without producing troublesome interface waves. These interface waves are associated with frequent failure, particularly in certain materials, in the form of cracks which emanate from the crests of the waves at an angle of approximately 45° to the plane of the interface. A second problem is that the vortex of each resultant wave contains a mixture of the two materials forming the bonded interface. In certain metal combinations, a brittle intermetallic interface is formed which substantially weakens the bond. The presence of waves imposes process limitations as wave amplitude increases as a function of increasing distance from the point of initiation. This ultimately reaches a point where the amplitude forms a relatively substantial proportion of the thickness of, say, the thinner material and failure again occurs in the form of cracks emanating from the wave crests. Turbulent flow of metal occurring during the formation of the waves also results in a high level of work hardening of the metal surface layers at the interface to affect the metal properties in this area. This is an undesirable result in many instances.

By eliminating the waves from the interface, the bond can be strengthened and the source of potential cracking removed. The size and area of clad metal plate which can be produced is no longer limited by the distance from the initiation point at which the onset of wave-ssociated cracking appears. Thus, by removing the interfacial waves to produce a flat interface, many of the current limitations of explosive bonding can be removed to considerably extend bonding capabilities and a superior bond can be achieved.

The interface geometry of any specific metal combination, which includes the shape of any waves produced or the production of a flat interface, is controlled by the angle, known as the collision angle β, at which the two colliding surfaces meet during bonding. This collision angle β is controlled by the following parameters:

(a) the detonation velocity of the explosive, (b) the velocity at which the surfaces are propelled towards each other, (c) the angle at which the two surfaces are initially inclined prior to the detonation of the explosive.

Each of these parameters is included in a bonding arrangement known as the angular geometry. Plain, or flat, interfaces have been produced in the past using this arrangement and these parameters are known to some degree. However, a full determination of their characteristics has not been possible because, when using the angular geometry arrangement, the aforesaid three factors are interdependent and steady state conditions for bonding cannot be implemented. The reasons why conditions are not steady state under the angular geometry arrangement are hereinafter explained.

SUMMARY OF THE INVENTION

It is an object of the present invention to provide an improved explosive composition for use in explosive bonding of two metals together which reduces the production of interface waves during the bonding process.

It is a further object of the invention to provide an improved explosive bonding method which reduces or prevents the production of disadvantageous interface waves.

It is a further object to provide a multi-metallic bonded product made by the aforesaid method and which is devoid of interface waves.

Accordingly, in one aspect, the invention provides an improved explosive composition comprising a base explosive in admixture with an inert particulate diluent, the improvement wherein said diluent comprises an inert material having a mean particle size selected from 0.05 mm to 0.1 mm, a hardness value of not less than 4 mohs, and a plurality of faces and edges.

The present invention provides a new form of diluent which can be added in relatively greater proportions than prior art diluents with a base explosive can produce an explosive mixture which can sustain detonation at velocities as low as 1,200 m/sec. Sand or grit, of a particular physical form as herein defined, is such a diluent.

The present invention thus gives a new capability to manufacture explosive mixtures which can produce explosive bonds characterized by having a flat interface which has reduced or is totally devoid of waves and their associated problems.

The particles size of the diluent is a feature which governs the preferred volume and weight of diluent which is added to attain a specifically desired velocity of detonation. The smaller the particle size the less volume or weight of diluent is required. The recommended particle size should, preferably, not be less than 0.05 mm and the maximum particle size should, preferably, not exceed 1 mm. The particle shape and hardness of the diluent are features which affect the sensitivity of the explosive composition and it is most preferred that the particles be both multi-faceted and angular with a hardness value exceeding 4 mohs if the sensitivity of the explosive is to be maintained when the proportion of diluent is sufficiently high to obtain detonation velocities as low as 1,200 m/sec. Provided these requirements are met, the diluent material can take various forms. A preferred diluent is sand or grit in the form of calcium silicate more conventionally used for the sand blasting of surfaces. The characteristics of these materials meet the aforesaid physical requirements of size, shape and hardness to give the desired preferred detonation velocities below 1,800 m/sec and which produce flat, explosively bonded interfaces when bonding by the parallel geometry as hereinafter explained.

Other diluents can be used provided that the diluent material contains an appropriate particle size distribution and the particles are of an equally appropriate shape and hardness. A proportion of particles outside this range can be included with little effect provided that this proportion is not excessive as the uniformity of the explosive performance will be affected as this proportion is increased. The respective proportions of the explosive mixture and the diluent will depend upon the characteristics of the two components. Preferably, the proportion of diluent of the form having the physical characteristics of use in the present invention, normally exceed 40% W/W if detonation velocities below 1,800 m/sec are to be obtained and sustained.

In a further aspect, the invention provides an improved method of explosively bonding a first metal to a second metal with an explosive composition comprising a base explosive in admixture with an inert particulate material, the improvement wherein said composition is as defined hereinbefore.

The method according to the invention is applicable to both explosive bonding wherein the metals are in the parallel relationship and the angular relationship as hereinafter described.

The invention in further aspects provides a method of explosively bonding a first metal to a second metal, the first metal having a first surface and a second surface, the second metal having a third surface, said method comprising (a) locating the first metal adjacent said second metal such that said first surface opposes said third surface; (b)locating an explosive composition adjacent said second surface; and (c) detoning said explosive as to effect displacement of said first metal towards said second metal to bond said first surface to said third surface, the improvement wherein said explosive composition comprises a composition as herein before defined.

Preferably, the first surface is located parallel to the third surface or at an acute angle to the third surface.

The invention composition and method is of particular value with ammonium nitrate containing base explosives, for example, amatol and ANFO.

In a further aspect the invention provides the multimetallic product of the aforesaid method, which product has relatively low or is devoid of interface waves The process according to the invention is valuable also in providing multi layered metal products comprising three or more explosively—bonded metals together. This is of particular value where two metals having an intervening third layer of a metal interlayered therebetween are explosively bonded according to the process of invention. A preferred example of such a process involves a niobium interlayer between a cladder of titanium and a steel substrate. The resultant trimetallic product is waveless at each of the two interfaces, i.e. at the niobium/steel interface and the niobium/titanium interface.

BRIEF DESCRIPTION OF THE DRAWINGS

In order that the invention may be better understood, preferred embodiments will now be described, by way of example only, with reference to the accompanying drawings wherein.

DETAILED DESCRIPTION OF PREFERRED EMBODIMENTS

Figure 1:
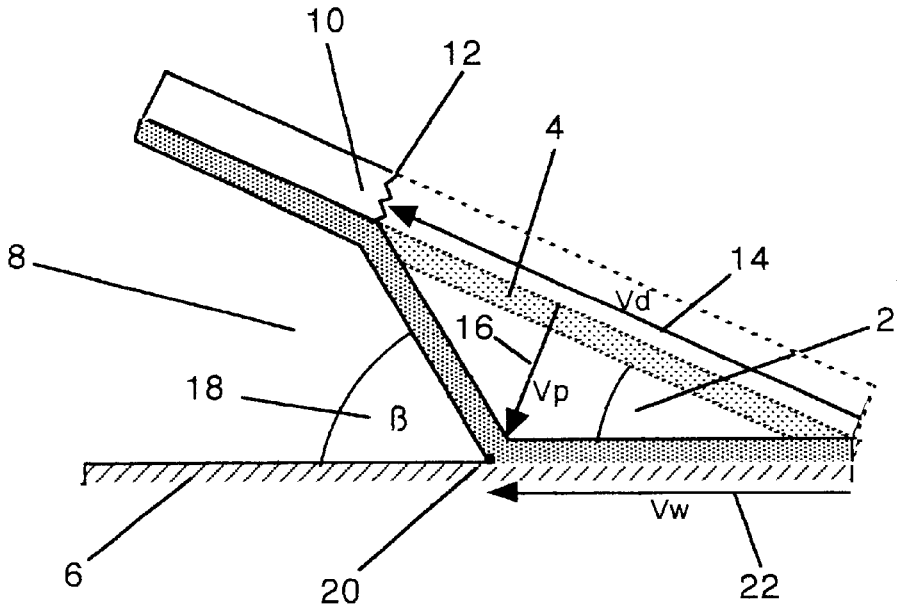
FIG. 1 is a schematic representation of an intermetallic angular geometric arrangement bonding process according to the prior art.

The reasons why bonding process conditions are not steady state when employing the aforesaid angular geometry arrangement can be explained with reference to FIG. 1 which shows the initial geometrical arrangement prior to bonding, in broken lines, and the situation during bonding in solid lines.

The initial angle of inclination 2 of the first metal, for example, niobium, clad component 4 to a second metal, for example, titanium, base or substrate 6, prior to bonding, produces a tapered stand-off gap 8. On detonation of explosive composition 10, the detonation front 12 travelling in the direction 14 at a velocity Vd can be maintained at a constant value, but the velocity Vp, at which cladder component 4 is impelled towards base 6 in the direction 16, is not constant due to the acceleration and, subsequently, deceleration of cladder component 4 over the increasing dimension of tapered stand-off gap 8. This variation of the velocity Vp results in an associated variation of collision angle 18 (β), which governs the interface geometry. The progressively increasing distance between cladder component 4 and base 6, over angular stand-off gap 8, results in a collision front 20, where the colliding surfaces 17 of cladder 4 and 19 of substrate 6 meet, which travels in the direction 22 at a velocity (Vw), which is substantially below that of the detonation velocity (Vd) of explosive 10.

An important feature of the angular geometry, therefore, is that high detonation velocity explosives can be employed, but bonding can still occur as the critical bonding velocity (Vw) is less than the detonation velocity (Vd), i.e. (Vw <Vd). Accordingly, the initial inclination of the component parts can be arranged relative to the explosive detonation velocity to reduce Vw to the required values and produce a choice of collision angle β which will give either flat or waved interfaces.

The application of explosive bonding on a commercial basis, however, demands the production of large metal component parts with extensive areas of bond. This is particularly true of explosively clad components where a substrate of cheaper metal, e.g. steel, is 'veneered' with a more expensive corrosion resistant, e.g. mobium, metal. Such large parts cannot be produced using the aforesaid angular set-up with its non-steady state conditions of bonding. The initial inclination of the component parts and their surfaces 17, 19 limits the area which can be bonded, as a point is quickly reached where the stand-off gap reaches unacceptable dimensions where the plate velocity cannot be maintained at a sufficiently high level to give the necessary collision pressure at the interface. This difficulty is generally overcome by the arrangement known as the "parallel geometry" in which the two component parts are initially spaced parallel to each other to provide a stand-off gap of uniform dimension. This method of bonding can be explained by reference to FIG. 2 which also shows the initial geometrical arrangement in broken lines and the situation during bonding in solid lines.

Figure 2:
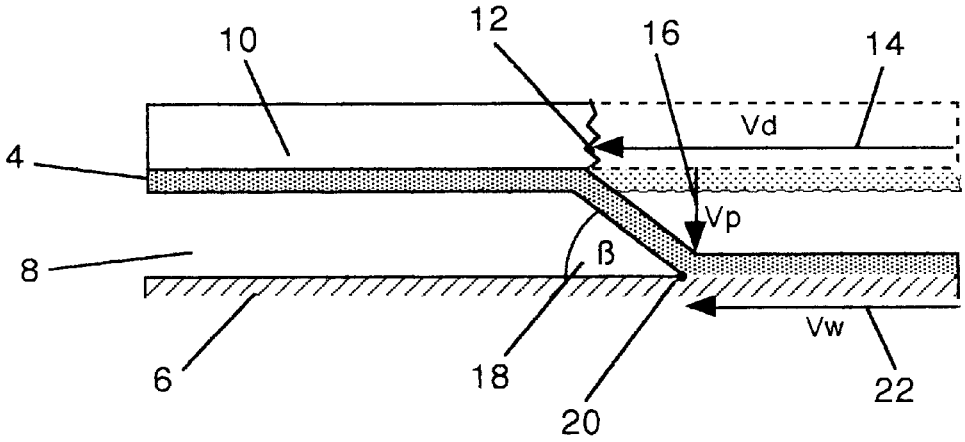
FIG. 2 is a schematic representation of an intermetallic parallel bonding process according to the prior art.

In the parallel arrangement of FIG. 2, there is no initial angle of inclination and cladder component 4 and base 6 lie parallel to each other at a small distance apart to produce a stand-off gap 8 which is of uniform dimension. On detonation of explosive 10, detonation front 12 travels in direction 14 at a velocity Vd which is constant and, because stand-off gap 8 is uniform, cladder component 4 is impelled over a uniform distance in direction 16 to reach a velocity Vp on its collision with base 6 at collision front 20 with plate velocity Vp being constant. Collision front 20 travels in direction 22 at a constant velocity Vw and, because stand-off gap 8 is uniform, Vw is identical to the velocity of detonation front 12 travelling at velocity Vd. With Vp, Vd and Vw being constant, the collision angle 18 (β) which is produced is also constant.

This parallel arrangement results in steady state conditions where the detonation velocity Vd, plate velocity Vp and collision front velocity Vw are constant. Further, because detonation velocity Vd and plate velocity Vp are independent of each other, they can be controlled individually to provide the desired collision angle β. The steady state conditions resulting from the parallel stand-off gap, allows extended areas of bond to be produced to provide practical commercial value.

The uniform stand-off gap of the parallel arrangement results in:

(a) a constant plate velocity (Vp) and associated collision pressure, (b) a constant collision angle (β), (c) a collision front velocity Vw which is constant and is identical to the detonation velocity of the explosive, i.e. Vw=Vd.

When employing the parallel bonding process, the bonding regime in which flat metallic interfaces are produced lies in a region where the collision front velocity (Vw) is below 1,800 metres per second and the associated collision angle β is high. The precise values of Vp and Vw and the related collision angle β depend upon the metal combination being bonded, their relative mechanical properties, their respective densities and the sonic velocities of the materials.

As the collision front velocity (Vw) and detonation velocity (Vd), are identical in the parallel arrangement, if the collision front velocity (Vw) is to be less than 1,800 m/sec. In order to produce a flat interface devoid of waves, the detonation velocity Vd of the explosive must also lie below 1,800 metres per second. Commercial cladding explosive normally have detonation velocities between 2,000 m/sec. And 3,000 m/sec. To produce identical values of Vw. However, at these values of Vd and Vw, the associated collision angle β will not sufficiently high to produce flat interfaces and the characteristics interfacial waves are produced.

Figure 3:
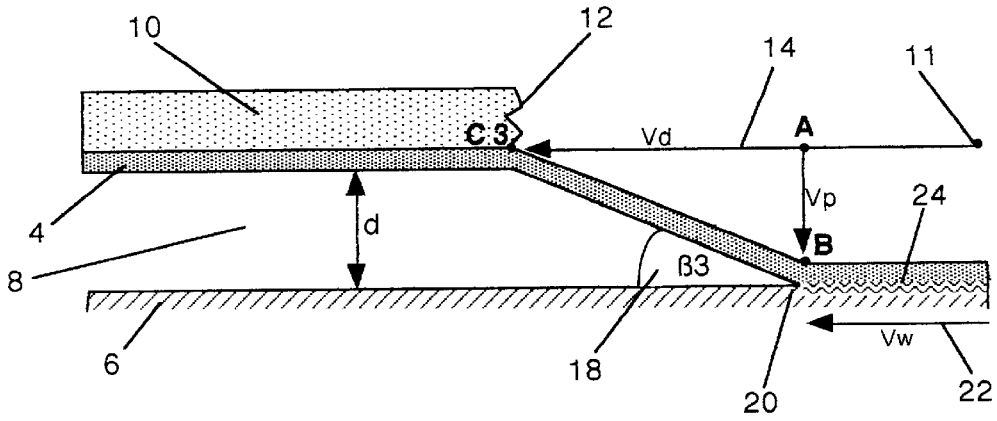
FIG. 3 illustrates the situation occurring during bonding in a parallel arrangement when employing an explosive mixture currently used in the prior art and with detonation at a velocity of 2,600 metres per second to produce a bonded interface with waves.

With reference now to FIG. 3, according to the prior art, cladder component 4 and base component 6 are initially placed a small distance apart to form a uniform stand-off gap 8. The explosive 10 is initiated at point 11 to produce a detonation front 12 travelling in the indicated direction 14 at the predetermined velocity Vd of 2,600 metres per second. At the moment when detonation front 12 reaches point A on the upper surface of cladder component 4, cladder component 4 is impelled downward over the stand-off gap 8 in the indicated direction 16 at a velocity Vp, to subsequently collide with base 6. Point A travels to point B, the detonation front 12, meanwhile, progressing forward at the velocity of 2,600 metres per second to reach point C1 covering a distance A–C1 and cladder component 4 deforming to produce the collision angle 18 (β1). A collision front 20 is formed traveling in the indicated direction 22 identical to the direction of detonation 14 at a velocity Vw which is also identical to the velocity of detonation Vd of the explosive at 2,600 metres per second. The collision angle 18 (β1) is relatively low the tangent of the angle being Vp/2,600. This relatively low angle produces a bonded interface 24 containing waves.

Figure 4:
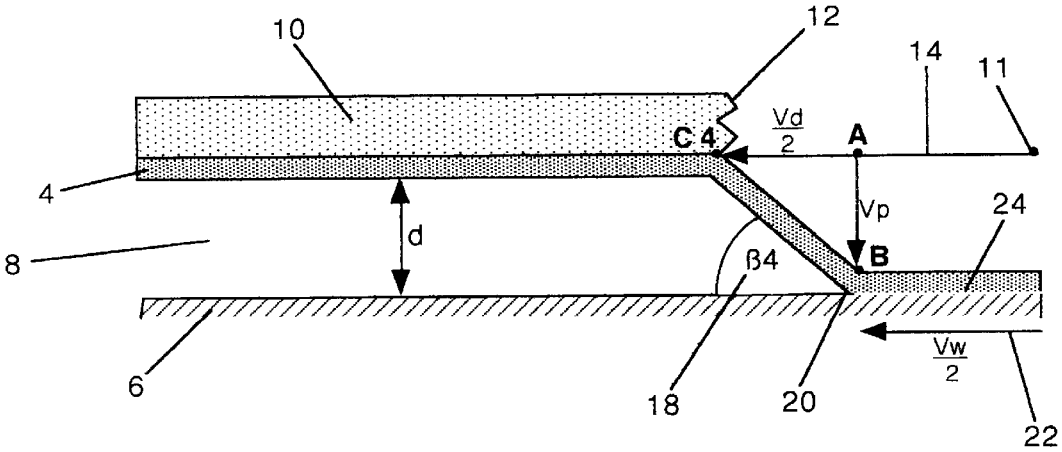
FIG. 4 shows a direct comparison with that of FIG. 3 of the situation during bonding according to a method of the present invention; and wherein the same numerals denote like parts.

With references to the comparative situation shown in FIG. 4, according to the invention, cladder component 4 and base component 6 are initially spaced apart to form a uniform stand-off gap 8, which is identical in dimension to that of the set-up of FIG. 3. An explosive mixture 10, containing diluent D according to the present invention, is initiated at point 11 to produce detonation front 12 travelling in the same indicated direction 14 at a predetermined velocity Vd/2 of 1,300 metres per second. At the moment when detonation front 12 reaches point A on the upper surface of the cladder component 4, the latter is impelled downward over stand-off gap 8 in indicated direction 16, at the identical velocity Vp to that of FIG. 3, to subsequently collide with base 6. Point A travels to point B at velocity Vp, detonation front 12, meanwhile, processes forward at velocity Vd/2 of 1,300 metres per second to reach point C2 over distance a–C2, which is now only half the distance A–C1 of FIG. 3 and cladder component 4 deforms to produce collision angle 18 (β2). A collision front 20 is formed traveling in indicated direction 22 identical to the direction of detonation 14 at a velocity Vw/2 which is also identical to the velocity of detonation Vd/2 of the explosive 1,300 metres per second. The collision angle 18 (β2) is relatively high, the tangent of the angle now being Vp/1,300 and produces a bonded interface 24 which is flat and devoid of waves.

EXAMPLES

The standard Dautriche Method was used to determine the detonation velocity of a 10 cm thick layer of the explosive composition according to the invention.

Example 1

An ANFO explosive composition consisting of 50% w/w ANFO, a stoichiometric mixture of 94% ammonium nitrate and 6% diesel oil, ind 50% w/w 'J BLAST', was made up. The 'J BLAST' is a proprietary brand of silica used in the sandblasting of stone work and consisted primarily of 35–45% silica, 35–45% calcium oxide and 10–15% aluminum oxide. The silica had particle sizes ranging from 0.05 to 0.1 mm, a hardness of 5–6 moh and of sharp angular form to be of value in the practice of the present invention.

A 10 cm deep layer of this explosive composition was found to have a detonation velocity of 1,300 m/sec, and was used to bond a 6mm thick cladder of titanium to a 50 mm thick steel substrate. Metallographic examination of the resulting clad multi-metallic composite showed a flat interface, i.e. it was devoid of the waves which characterizes the conventional prior art explosive-bonded interface. No intermnetallics were present at the interface and the bond had a shear strength in excess of 60,000 psi.

Example 2

An explosive composition consisting of 43% ANFO and 57% 'J BLAST' was prepared. A 22.5 cm deep layer of this explosive composition detonated at a velocity of 1,625 m/sec and was used to bond a 12.5 mm cladder of titanium through an intervening 0.5 mm thick niobium interlayer to a steel substrate of 15 mm thickness, in a single bonding operation.

A ductile bond was obtained having a shear strength of 50,000 psi. Metallography showed a waveless condition at each of the two interfaces, i.e. the niobium/steel interface and the niobium/titanium interface.

Example 3

An explosive composition consisting of 50% w/w amatol explosive and 50% 'J BLAST' silicate-based sandblasting material was prepared. Amatol is an explosive mixture consisting of 80% w/w ammonium nitrate and 20% w/w trinitrotoluene (TNT).

A 10 cm deep layer of the aforesaid composition was found to have a sustainable detonation velocity of 1,460 m/sec.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated.

What is claimed is:

1. An explosive composition comprising a base explosive selected from amatol and ANFO in admixture with an inert particulate diluent present in an amount of at least 40% w/w consisting primarily of 35–45% silica, 35–45% calcium oxide and 10–15% aluminum oxide, wherein said silica has a mean particle size selected from 0.05 mm to 0.1 mm, a hardness value of not less than 4 mohs and a plurality of faces and sharp edges.

2. A composition as defined in claim 1 wherein said silica is present in an amount to operably provide said composition with a sustainable detonation velocity of less than 1800 m/s.

3. A composition as defined in claim 2 wherein said silica is present in an amount to operably provide said composition with a sustainable detonation velocity of less than 1200 m/s.

* * * * *